United States Patent [19]

Vettor et al.

[11] Patent Number: 4,881,946

[45] Date of Patent: Nov. 21, 1989

[54] PROCESS FOR THE BENEFICIATION OF COAL BY SELECTIVE CAKING

[75] Inventors: Antonio Vettor, San Donato Milanese; Nello Passarini, Colturano; Armando Marcotullio, San Donato Milanese, all of Italy

[73] Assignee: Eniricerche S.p.A., Milan, Italy

[21] Appl. No.: 276,680

[22] Filed: Nov. 28, 1988

[30] Foreign Application Priority Data

Dec. 16, 1987 [IT] Italy ..... 23037 A/87

[51] Int. Cl.[4] ..... C10L 15/00

[52] U.S. Cl. ..... 44/627; 44/621

[58] Field of Search ..... 44/621, 627, 620; 209/171, 173

[56] References Cited

U.S. PATENT DOCUMENTS

| | | | |
|---|---|---|---|
| 4,033,729 | 7/1977 | Capes et al. | 44/621 |
| 4,263,013 | 4/1981 | Smith, Jr. | 44/621 |
| 4,484,928 | 11/1984 | Keller, Jr. | 44/627 |

FOREIGN PATENT DOCUMENTS

| | | | |
|---|---|---|---|
| 1163943 | 3/1984 | Canada | 44/627 |
| 96679 | 6/1983 | Japan | 44/621 |

*Primary Examiner*—Carl F. Dees

*Attorney, Agent, or Firm*—Hedman, Gibson, Costigan & Hoare

[57] ABSTRACT

A process is disclosed for the beneficiation of coal by selective caking, in which process a caking mixture is employed consisting of:

one or more solvents selected from among light hydrocarbons having boiling points not higher than 70° C.;

a non-ionic, oil-soluble additive obtained from controlled propoxylation of the phenolic fractions derived from cake-oven tars;

and possibly one or more heavy co-caking agents selected from among coal-derived oils having boiling points between 200° and 400° C., or the residual products of petroleum refining or mixtures of the same.

15 Claims, No Drawings

PROCESS FOR THE BENEFICIATION OF COAL BY SELECTIVE CAKING

This invention relates to a process for the beneficiation of coal by selective caking.

Processes which are most known for the purification of coal are mainly based on the difference between the physical properties of the predominantly organic matter and of the predominantly inorganic matter.

For instance, such materials can be separated on the basis of their sizes, or of their densities, or of their different electric or magnetic behaviour.

Said processes however ae not always conveniently applicable when the physical properties of the materials to be separated are quite similar. A solution to that problem is given by the exploitation of another property of the phases to be separated: their different affinities for water, a property that can be typically employed in caking and foam flotation processes.

More particularly, the caking process consists in forming a water-coal dispersion to which an organic compound of hydrocarbon nature is added with stirring, in order to produce caked or agglomerated materials which are made up mainly of pure coal and an aqueous dispersion containing solids which are predominantly inorganic in nature. Petroleum-derived fuel oils, heavy oils from distillation of coal pyrolysis tars, petroleum middle distillates (kerosene, gasoil, etc.) are employed as organic caking compounds.

A drawback of that process consists in the fact that oil employed for causing coal to cake is normally left behind in the product, so that as a consequence the cost of the process is remarkably increased and the next step of making the beneficiated coil into a slurry of coal-water mixture (CWM) possibly carried out is made much more complex (or even impossible).

On the other hand, the eventual recovery of the caking agent would be an economic burden equally or even much more onerous, because of the poor volatility of the products mentioned above.

For obviating such drawbacks, use can be made of volatile hydrocarbon solvents and their derivatives as caking agents, as such compounds can be recovered after the inorganic matter has been removed. Light hydrocarbon solvents employed are mainly n-pentane, n-hexane, petroleum ethers and their fluorochloroderivatives (Freons). Said solvents generally show a higher selectivity than heavy solvents, but light solvents have the drawback with respect to the heavy ones of lower bridging power, so that some coals having more unfavourable surface properties can be caked or agglomerated with heavier oils but not with lighter ones.

A caking process has been recently claimed in the Japanese patent kokay (published before examination) JP No. 84/105089, said process employing together with a caking agent (chosen from paraffin oil, light oil (petrol), crude oil, asphalt, coal liquefaction oil, low-temperature tar, high temperature tar, all kinds of residual oil and fuel oil (a preferred solvent)), also a non-ionic, oil-soluble compound as an additive, in particular ethoxylated nonylphenol in amounts of at most 5% by weight with respect to the caking agent.

According to the Authors of said patent application, the process claimed therein shows much higher caking rates, as well as lower amounts of the caking agent employed and higher dehydration (lower water percentages in the caked product), and it allows less amounts of minerals to be obtained in the product.

Thus such process is an improvement with respect to the employment of the mentioned products only, but it is unsuitable to a final economic recovery of the caking agent because of the poor volatility of the liquid compounds claimed and in addition it shows the same drawbacks already mentioned above, in case such coal so beneficiated should be employed for production of CWM mixtures.

Finally, in such process the possibility is not considered of applying the same for processing partially oxidated coals which are otherwise uncakable or unagglomerable.

This last aspect has been tackled by other researchers (e.g., D. V. Keller, U.S. Pat. No. 4,484,928) who claimed the use, together with light or heavy caking agents, of various additives such as carboxyl acids (in particular, oleic acid and its salts), amines, alcohols and their derivatives, etc., for causing partially oxidated coals to cake. In the same patent, Keller also reports the employment of an ethoxylated phenol (whose composition is not given) and a way for shortening remarkably the caking times of a coal which is already agglomerable by itself. However, both the employment of acid or basic products and the employment of ethoxylated phenols does not allow the caking of many coals which are particularly hard to cake because of the low bridging power of the caking liquids employed (Freons, n-pentane, n-hexane, petroleum ethers), as will be shown in the examples of the following disclosure.

On the other hand, it is to be stressed that the problem of surface oxidation is particularly important also for coal types that are not deteriorated at the starting point, in case that the production of very fine granule sizes (for instance 20 μm) is indispensable because of higher degrees of liberation and/or because of pro-CWM granulometric predisposition. Indeed, in that case the prolongation of the mechanical treatment in micronizing mills causes a very high oxidating effect, so that coals that cake quite easily when their granulometries are larger, do not cake at all after milling to the high levels of fineness mentioned above.

In the present instance, it was surprisingly found that, employing a given caking mixture it is possible to cake unagglomerable or hardly agglomerable coals, or coals that cakable at larger granulometries but not at high degrees of fineness, because of the thermooxidative effects of milling to high fineness (about 20 μm), even when working with light solvents.

Very good results are simultaneously obtained in terms both of selectivity and of recovery.

Indeed, coal types such as a high-volatiles bituminous Russian coal, and at a higher extent an American subbituminous coal (from Montana) and a subbituminous Italian coal (from Sulcis), that do not cake with pentane alone or with pentane added with ethoxylated phenol because of their poor surface hydrophobic properties, can be caked by means of the mixture employed in the present invention.

In a similar way, a coal from Poland that cakes very well at larger granule sizes, does not cake at all or cakes at an extremely low extent when milled at −20 μm. Very good results can be again obtained through the employment of our caking mixture. Obviously, it is also possible with such caking mixture to obtain advantages both in terms of shortening of caking time and in terms of the amount of caking agent required as well as of selectivity, yield and water percentage in the caked product, also in the case of coals that are already agglomerable.

Moreover, such way shows also quite convenient from the economic standpoint due to the very low concentration of the products employed in the caking solvent (which are not intended for being recovered).

In addition, no problem is met with in case that coal so beneficiated is to be employed for the production of CWM mixtures; indeed, keeping into account the advantageous effect given by the presence of such hydrophobe-making products (in small amounts) on coal (improvement in its rheological properties), it can be set forth that such caking mixtures are very suitable to the beneficiation of coal intended for the production of CWM mixtures.

The process for the beneficiation of coal which is the object of the present invention through selective caking is characterized in that it makes use of a caking mixture consisting of:

one or more solvents selected from light hydrocarbons having boiling points not higher than 70° C.;

a non-ionic, oil soluble additive obtained from controlled propoxilation of the phenolic fractions derived from coke-oven tars;

possibly, one or more heavy co-caking agents selected from coal-derived oils having boiling points between 200° C. and 400° C. or the residual products of petroleum refining or mixtures of the same.

The solvent or the solvents are preferably contained in amounts between 2% and 50% by weight with respect to coal, and more preferably between 3% and 20% by weight. Preferred light hydrocarbons are n-pentane, n-hexane and petroleum ethers.

The additive (intended as the hydroxyl-derived active part) is preferably contained in amounts between 0.02 and 1% by weight with respect to coal, and more preferably between 0.05 and 0.3% byy weight.

Such additive is obtained in particular from phenolic compounds derived from distillation of coke-oven tars.

For example, starting from tar and by previous removal of the water phase, a first distillation is carried out, which yields a cut that is commonly called "naphthalene-containing middle oil" which is to be processed mainly for recovering naphthalene. Dephenolizing of such fraction with diluted soda, reacidification of phenols and distillation of the phenolic mixture are also provided. The distillate so obtained, consisting of a very complex mixture of phenols, is one of raw materials for the preparation of propoxylated additives.

The other cuts of interest can be obtained in the case of partial dephenolizing or in the absence of dephonolizing; in that case, during successive distillation stages, light fractions (BTX) and middle fractions with variable distillation ranges are obtained.

Such fractions yet contain phenols which are of interest but are diluted at various concentrations in more or less heavy aromatic oils. Obviously such phenols concentration, as well as the composition of the non-phenolic aromatic part, depend on the upper limit of distillation temperature; in particular, phenols are generally obtained at concentrations not higher than about 30% by weight.

This second class of products is employed according to the concentration of active hydrogens; whereas the non-active compounds have the same function as heavy oils disclosed in the following (co-caking agents).

Such fractions so derived can also be ethoxylated in addition to be propoxylated.

The stoichiometric ratios between active hydrogens of the phenolic substrate (z) and the propylene oxide moles (x) and possibly the ethylene oxide moles (y) are:

z:x:y where $z=1$ x is in the range from 4 to 100, preferably from 6 to 50 y is in the range from 0 to 20, preferably from 0 to 10 and x/y is greater than or equal to 2, 3, and preferably greater than or equal to 4 when y is greater than zero.

The process for propoxylating the phenolic cuts obtained from distillation of coke-oven tar can be carried out by reacting said phenolic fractions with propylene oxide at a temperature preferably in the range from 140° to 160° C., preferably for 0.5–3 hours and at a pressure preferably in the range from 5 to 10 atm.

In case that the fractions mentioned above are also ethoxylated, ethylene oxide is reacted at a further stage through a block reaction.

The heavy co-caking agent(s) possibly present is/are contained in amounts between 0% and 3% by weight with respect to coal, and more preferably between 0.2 and 2% by weight. Such products employed in so low amounts can also be conveniently left behind in the beneficiated coal without heavy economic burdens.

Coal-derived oils can be obtained by pyrolysis or by coking or by hydroliquefaction of coal itself. More particularly, they can be obtained from coke-oven tar and in particular from distillation of coke-oven tar.

Normally, oils obtained from distillation of coke-oven tar of coal or obtained through successive fractionations by distillation.

For instance, two products that can be used as co-caking agents are obtained already from the first distillation process, i.e., a crude anthracene oil from first distillation (having boiling point between 230° and 400° C.) and an anthracene oil from second distillation (boiling point 270°–400° C.), and a lighter product is also obtained (the "naphthalene middle oil" is already mentioned above) that cannot be employed as a caking agent. However, other cuts are obtained from said lighter products after dephenolizing and further redistillation, the heaviest cuts of which can be employed as co-caking agents (the gas washing oil (debenzolizing oil") having boiling point of 235°–300° C., and pasty anthracene oil (300°–400° C.)). Such oils from distillation of coke-oven tar of coal can be employed alone or as mixtures of the same. A particular mixture of such oils is for instance creosate oil which is made up of mixtures of anthracene oils. The products which are not liquid ("pasty products") at room temperature can be employed as such or otherwise in the fluid state by previous controlled crystallization and filtration of the starting pasty product.

A typical composition of a pasty anthracene oil is shown in Table 1.

TABLE 1

Main features and typical composition of the pasty anthracene oils

| | |
|---|---|
| Fluidification temperature: | 70–80° C. |
| Distillation range: | 300–400° C. |

TABLE 1-continued

| Main features and typical composition of the pasty anthracene oils | |
|---|---|
| Density: | 1.13–1.14 |
| Approximate composition: | 5% acenaphthene and fluorene |
| 30% phenanthrene | |
| 10% anthracene | |
| 10% carbazole | |
| 5% pyrenes | |
| 2% products containing heteroatoms (N and O) | |

the balance to 100 is given by higher homologous compounds of the products listed above.

The "fluidized" variant contains about less 40% of anthracene and carbazole, whereas the higher homologous compounds, being for the main part in the liquid state, are left behind in the filtered product.

The residual products of petroleum refining can be those coming from the bottoms of distillation under atmospheric pressure, of distillation in vacuo or of cracking processes. Said residual products can be employed as such or they can be previously "fluxed" with middle distillates (gasoil, kerosene, and so on).

The "fluxed" residual products are more commonly called fuel oils.

The stages which the process of the present invention is made up of are those already known, i.e. the following:

- milling coal to a granulometry not higher than 4 mm, preferably not higher than 1 mm;
- dispersing milled coal into water to concentrations between 5 and 40% by weight with respect to the dispersion itself;
- adding to the dispersion so obtained the caking mixture, as such or in the form of a water emulsion previously prepared;
- stirring at high speed the dispersion for times preferably between 1 and 20 minutes;
- possibly stabilizing and growing the coalescence products through gentle stirring for times preferably between 1 and 20 minutes;
- separating the caked product from inorganic matter dispersed in the water phase through screening and possibly washing the caked product, or through skimming, or through decantation.

In order to better illustrate the meaning of the meaning of the present invention, some examples are reported in the following which are not to be considered as limitative of the present invention.

The main feature of the coals employed in said examples are summarized schematically herein:

- 2 of said coals are of the high-volatile bituminous type, but with different degrees of surface oxidation (from Poland, from Columbia);
- 2 of said coals are sub-bituminous, and as such they are much unfavoured both by the type and by a prolonged exposure to atmospheric agents (an American coal from Montna, an Italian coal from Sulcis).

For the two bituminous coals the following Table shows the (comparison) results of a XPS (X-rays photo Spectrometry) surface analysis which are most meaningful, in terms of the carbon/oxidized carbon ratio ($C/C_{ox}$).

TABLE 1

| Coals | Type | Ashes % by weight | Surface oxidation | $C/C_{ox.}$ ratio |
|---|---|---|---|---|
| from Poland | high-volatile bituminous | 10.5 | weak | 5.2 |
| from Columbia | high-volatile bituminous | 10.3 | strong | 2.6 |
| from Montana (U.S.A.) | subbituminous | 21.5 | strong | |
| from Sulcis (Italy) | subbituminous | 22.0 | strong | |

EXAMPLE 1

A high volatile bituminous coal from Columbia, containing 10.3% by weight of ashes (see Table 1) is milled to a maximum granulometry of 750 μm.

50 g of said coal are dispersed into 200 ml of water and stirred in a suitable glass reactor provided with baffles and a double blade-turbine stirrer in order to allow a complete wetting to be obtained of the phase reachest in inorganic matter. The stirring time is of 5 minutes and the stirring speed is of 1000 rounds per minute (rpm).

After previously increasing speed up to 2,000 rpm, the caking mixture is added, said mixture consisting of 7 g of light solvent (n-hexane, 14% by weight on the coal basis (c.b.)), 0.5 g of fuel oil (1% by weight c.b.) and 0.025 g (0.05% by weight c.b.) of distilled phenolic mixture (from the dephenolizing process of the coke-oven tars of coal) reacted with propylene oxide (six units per active hydrogen) according to the reaction ways disclosed in the example 23.

The stirring at high speed is kept for 10 minutes in order to allow the caking packet to develop an efficient action; then the stirring speed is reduced to 1,000 rpm and stirring is kept for 5 minutes in order to optimize the sizes of the caked products.

Then the final recovery of the caked product is carried out by screening with a screen having mesh sizes of 750 μm.

The caked product is characterized in terms of weight and of composition (ash percentage).

Results obtained were the following:

| | |
|---|---|
| recovery of heat value | 94% by weight |
| ash percentage | 2.1% by weight |

EXAMPLE 2

The composition only is changed with respect to example 1 of the propoxylated additive: in the present instance, the adduct obtained as in the example 1 is employed, but employing 15 oxypropylenic units per active hydrogen.

The time required for the stirring stage at high speed is of 10 minutes.

The results are the following:

| | |
|---|---|
| recovery of the heat value | 93.4% by weight |
| ash percentage | 2.3% by weight |

EXAMPLE 3

The only change with respect to example 1 is the substitution of an equal amount of anthracenic oil for fuel oil. The time needed for the stirring stage at high speed is of 10 minutes.

The results were the following:

| | |
|---|---|
| recovery of the heat value | 93.0% by weight |
| ash percentage | 2.0% by weight |

EXAMPLE 4

The composition only is changed of the phenolic additive with respect to example 1: in that case a block copolymer is obtained by the oxypropylation of the usual phenolic material with 10 oxypropylenic units per active hydrogen, followed by ethoxylation with 2 oxyethylenic units (again per active hydrogen). The time necessary for the stirring stage at high speed is of 10 minutes.

The results obtained are the following:

| | |
|---|---|
| recovery of the heat value | 94.9% by weight |
| ash percentage | 2.2% by weight |

EXAMPLE 5

With respect to example 1, the additive is added in amounts of 0.2% by weight c.b., and fuel oil is added in amounts of 2% by weight c.b.

The time necessary for the stirring stage at high speed is of 5 minutes.

The results obtained are the following:

| | |
|---|---|
| recovery of the heat value | 96.0% by weight |
| ash percentage | 2.4% by weight |

EXAMPLE 6

With respect to example 1, the amount of fuel oil is changed from 1% by weight c.b. to 0.5% by weight c.b.; moreover, the additive employed, at a percentage of 0.1% by weight c.b., has been obtained as follows: the phenolic matter consisting of the cut distilling after the BTX (benzene-toluene-xylene), and containing 30% by weight of proper phenolic compounds, reacted with 4 oxypropylenic units per each active hydrogen was propoxylated according to the reaction ways disclosed in example 23.

The time necessary for the stirring stage at high speed was of 10 minutes.

The results were as follows:

| | |
|---|---|
| recovery of the heat value | 93.3% by weight |
| ash percentage | 2.2% by weight |

EXAMPLE 7 (COMPARATIVE)

With respect to example 1, the use of the propoxylated phenol type additive is eliminated and fuel oil is replaced by anthracenic oil in amounts of 3% by weight c.b.

The caking effect does not reach good levels, even by prolonging the stirring stage at high speed up to thirty minutes and by increasing the amount of n-hexane as a solvent up to 30% by weight c.b.; indeed, recovery of caked products is very precarious and the best results obtained are as follows:

| | |
|---|---|
| recovery of the heat value | 45% by weight |
| ash percentage | 1.8% by weight |

EXAMPLE 8 (COMPARATIVE)

With respect to example 1, the use of the propoxylated phenol type additive is eliminated and the amount of fuel oil employed is increased up to 3% by weight c.b.

The caking effect does not reach good levels even by prolonging the stirring stage at high speed up to 30 minutes and by increasing the amount of n-hexane as a solvent up to 30% by weight c.b.; indeed, the recovery of the caked products is very precarious, and the best results obtained are as follows:

| | |
|---|---|
| recovery of the heat value | 62% by weight |
| ash percentage | 1.8% by weight |

EXAMPLE 9 (COMPARATIVE)

With respect to example 1, the use of fuel oil is eliminated, and the amount of the propoxylated phenol type additive is increased to 0.2% by weight c.b.

The caking effect does not reach good levels even by prolonging the stirring stage at high speed up to 30 minutes and by increasing the amount of n-hexane as a solvent up to 30% by weight c.b.; the best results obtained are not higher than 20% by weight expressed as the recovery of the heat value, so that the caking operation can be considered as failed.

EXAMPLE 10 (COMPARATIVE)

With respect to example 1, the use of the additive as well as of the fuel oil is eliminated.

The solvent n-hexane is also experimented in amounts of 30% by weight c.b. and for stirring times at high speed up to 30 minutes.

In all cases the recovery of the heat value was not higher than 10% by weight, so that the caking operation is considered as failed.

EXAMPLE 11

With respect to example 1, an American sub-bituminous coal from Montana (USA) having an ash percentage of 21.5% by weight was processed.

Moreover, the same propoxylated additive was employed but in amounts of 0.2% by weight c.b., and the amount of fuel oil was increased to 2% by weight c.b.

The time necessary for the stirring stage at high speed was of 10 minutes.

The results were as follows:

| | |
|---|---|
| recovery of the heat value | 96.0% by weight |
| ash percentage: | 11.8% by weight |

EXAMPLE 12 (COMPARATIVE)

With respect to example 11, the use of the propoxylated additive is eliminated, and the time of stirring at high speed is increased up to 30 minutes, while the amount of the solvent n-hexane is increased up to 30% by weight. In all cases the heat value recovery is not higher than 10% by weight, so that the caking operation can be considered as failed.

EXAMPLE 13 (COMPARATIVE)

With respect to example 11, the use of the additive as well as of the fuel oil is eliminated; in addition, the time of the stirring stage at high speed is also prolonged up to 30 minutes and the amount of the solvent n-hexane is increased up to 30% by weight c.b.

In all cases the heat value recovery is not higher than 10%, so that the caking operation can be considered as failed.

EXAMPLE 14

With respect to example 1, an Italian sub-bituminous coal from Sulcis having an ash percentage of 22% by weight is processed.

The same additive is employed, but at a concentration of 0.1% by weight c.b., and the concentration of fuel oil is increased up to 2% by weight c.b. The time necessary for the stirring stage at high speed is of 8 minutes.

The results obtained are as follows:

| | |
|---|---|
| recovery of the heat value | 90% by weight |
| ash percentage | 10.2% by weight |

EXAMPLE 15

With respect to example 14, the propoxylated additive is employed that was also used in example 6, in the same ratios.

The stirring time at high speed is of 8 minutes.

The results obtained are as follows:

| | |
|---|---|
| recovery of the heat value | 88% by weight |
| ash percentage | 10.3% by weight |

EXAMPLE 16 (COMPARATIVE)

With respect to the example 14, the use of the propoxylated additive is eliminated, while the stirring time at high speed is increased up to 30 minutes, and the amount of n-hexane as a solvent is also increased up to 30% by weight c.b.

In all cases, a heat value recovery is obtained lower than 20% by weight, so that the caking operation can be considered as failed.

EXAMPLE 17 (COMPARATIVE)

With respect to example 14, the use of the propoxylated additive as well as of the fuel oil is eliminated. Moreover, the stirring time at high speed is also increased up to 30 minutes and the amount of n-hexane as a solvent is increased up to 30% by weight c.b.

In all cases, a heat value recovery lower than 20% is obtained, so that the caking operation can be considered as failed.

EXAMPLE 18

With respect to example 1, a high-volatile bituminous coal from Poland, having an ash percentage of 10.5% by weight is processed, and the use of fuel oil is eliminated.

The stirring time at high speed is of 45 seconds.

The results obtained are as follows:

| | |
|---|---|
| recovery of the heat value | 94.0% by weight |
| ash percentage | 4.1% by weight |

EXAMPLE 19

With respect to example 18, an amount of 0.5% by weight of fuel oil is also employed in the caking phase.

The stirring time at high speed is of 30 minutes.

The results obtained are as follows:

| | |
|---|---|
| recovery of the heat value | 97% by weight |
| ash percentage | 4.1% by weight |

EXAMPLE 20 (COMPARATIVE)

With respect to example 18, n-hexane is only employed at the concentration of 14% by weight c.b. as the caking phase.

The stirring time at high speed is of 3 minutes.

The results obtained are as follows:

| | |
|---|---|
| recovery of the heat value | 95.0% by weight |
| ash percentage | 4.5% by weight |

EXAMPLE 21

A selective caking process is carried out wtih a coal from Poland whose granulometry is lower than 20 μm, prepared as follows:

A common laboratory ball-mill, made up of four vessels endowed with arotary planetary motion and with milling balls in suitable amount and of suitable sizes, is charged with a 30% by weight water-coal slurry. The starting maximum size of coal is 1 mm.

The milling time is of 60 minutes. The slurry so obtained is diluted to 10% by weight and is employed in the caking test in an amount of 250 g, with the apparatus disclosed in example 1. Use is made of 7.5 g of n-hexane (30% by weight c.b.), 0.25 g of fuel oil (1% by weight c.b.) and 0.025 g of the same propoxylated phenolic additive as that employed in example 1 (equal to 0.1% by weight c.b.).

The stage of high speed stirring is kept for 5 minutes.

The results obtained are as follows:

| | |
|---|---|
| recovery of the heat value | 96.0% by weight |
| ash percentage | 1.2% by weight |

EXAMPLE 22 (COMPARATIVE)

With respect to example 21, just n-hexane is employed as a solvent in amounts of 30% by weight c.b. and of 50% by weight c.b., while the stirring time at high speed is increased up to 30 minutes.

In all cases a heat value recovery lower than 20% is obtained, so that the caking operation can be considered as failed.

EXAMPLE 23

Propoxylation of phenic acids from coal tars 115.7 g of phenic acids obtained by distillation of coke-oven tars and added with 3.42 g of milled KOH is charged into a 1 liter autoclave. The autoclave is sealed, a sealing test is carred out at 10 kg/cm$^2$ and the contents are purified six times by bubbling nitrogen at 5 kg/cm$^2$.

A small cylinder containing 373 g of propylene oxide is placed on the autoclave and connected to the same through a nylon flow pipe.

The top of the small cylinder is connected to a nitrogen cylinder provided with a pressure reducing valve and a pressure gauge; the pressure is always kept at a value higher than that in the autoclave by 8 kg/cm$^2$.

The autoclave is depressurized so as to leave a residual nitrogen pressure of about 0.5–1 kg/cm$^2$, and then the heating is started.

Propylene oxide is delivered at the starting point with stirring (1,200–1,500 rpm) and at 144° C., while keeping surely a pressure difference of at least 5 kg/cm$^2$ between the autoclave and the ethylene oxide container, and also checking visually the passing of the propylene oxide. As soon as propylene oxide enters the autoclave, a temperature increase from 144° C. to about 160° C. is observed, and a pressure increase from 1 kg/cm$^2$ to 2.5 kg/cm$^2$ is also observed, which put into evidence the start of the reaction. At that point, heating is stopped. The reaction temperature is controlled between 150° C. and 160° C. by adjusting the delivery rate of propylene oxide and by removing heat by means of circulation of water through the oil bath coil.

The pressure in the autoclave is kept at a value of about 2 kg/cm$^2$.

After 55 minutes, the delivery of propylene oxide being over, the reaction is carried out for 1 hour at 160° C. to exhaust non-reacted propylene oxide completely.

When this post-reaction phase is completed, the autoclave is put into a cooling bath.

When the temperature is lowered to 80° C., the gas phase of the autoclave is vented through a trap cooled with dry-ice-alcohol, in order to stop any possible traces of unconverted propylene oxide.

The autoclave is cleaned repeatedly with nitrogen, then it is open and its charge is removed, with recovery of 490 g of propoxylated product.

We claim:

1. A process for the beneficiation of coal by selective caking, characterized in that a caking mixture is employed consisting of:

one or more solvents selected among light hydrocarbons having boiling points not higher than 70° C.;

a non-ionic oil soluble additive obtained by controlled propoxylation of phenolic cuts derived from coke-oven tars;

possibly, one or more heavy co-caking agents selected among coal-derived oils having boiling points between 200° and 400° C., or the residual products of petroleum refining or mixtures of the same.

2. A process according to claim 1, wherein the solvent or the solvents is/are contained in amounts between 2% and 50% by weight with respect to coal, the additive is in amounts between 0.02 and 1% by weight with respect to coal, and the heavy co-caking agent or agents is/are in amounts between 0% and 3% by weight with respect to coal.

3. A process according to claim 2, wherein the solvent or the solvents is/are contained in amounts between 3% and 20% by weight with respect to coal, the additive is in amounts between 0.05 and 0.3% by weight with respect to coal, and the heavy co-caking agent or agents is/are in amounts between 0.2 and 2% by weight with respect to coal.

4. A process according to claim 1, wherein the light solvent or solvents is/are selected from n-pentane, n-hexane and petroleum ethers.

5. A process according to claim 1, wherein the propoxylated phenolic fractions are also ethoxylated.

6. A process according to claims 1 or 5, wherein the stoichiometric ratios between the active hydrogens of the phenolic compound or the alkyl-phenolic compound (z) and the moles of propylene oxide (x) and eventually of ethylene oxide (y) are:

z:x:y wherein z=1 x is between 4 and 100, preferably between 6 and 50 y is between 0 and 20, preferably between 0 and 10, and x/y is greater than or equal to 2.3, when y is greater than zero.

7. A process according to claim 6, wherein x is between 6 and 50 y is between 0 and 10 x/y is greater than or equal to 4, when y is greater than zero.

8. A process according to claim 1, wherein the co-caking agent or agents is/are selected among anthracene oils and gas washing oil, taken alone or as a mixture of the same.

9. A process according to claim 8, wherein the anthracene oil mixtures are creosote oils.

10. A process according to claim 1, wherein the bottoms of petroleum refining comes from residual products of atmospheric distillation or of vacuum distillation or cracking processes.

11. A process according to claim 10, wherein the residual products of petroleum refining are fuel oils.

12. A process according to claim 1, wherein coal-derived oils are obtained through pyrolysis of through coking or through hydroliquefaction of coal itself.

13. A process according to claim 12, wherein coal-derived oils are obtained from coke-oven tars.

14. A process according to claim 13, wherein coal-derived oils are obtained from distillation of coke-oven tars.

15. A process according to claim 1 wherein phenolic fractions are obtained from distillation of coke-oven tars.

* * * * *